United States Patent [19]

Lamort

[11] Patent Number: 4,842,777

[45] Date of Patent: Jun. 27, 1989

[54] PRESSURIZED MIXING INJECTOR

[75] Inventor: Jean-Pierre Lamort, Vitry Le Francois, France

[73] Assignees: E & M Lamort, France; Feldmuhle AG, Fed. Rep. of Germany

[21] Appl. No.: 226,638

[22] Filed: Aug. 1, 1988

[30] Foreign Application Priority Data

Aug. 7, 1987 [FR] France ..... 87 11273

[51] Int. Cl.[4] ..... B01F 3/04

[52] U.S. Cl. ..... 261/79.2; 261/DIG. 75; 209/170; 417/176; 417/179; 417/194; 417/196

[58] Field of Search ..... 261/76, DIG. 75, 79.2; 209/170; 417/176, 194, 179, 196

[56] References Cited

U.S. PATENT DOCUMENTS

| | | | |
|---|---|---|---|
| Re. 21,416 | 4/1940 | Sargent | 417/196 |
| 2,057,218 | 10/1936 | Timpson | 417/176 |
| 2,268,063 | 12/1941 | Spackman | 11/179 |
| 3,659,962 | 5/1972 | Zink et al. | 417/179 |
| 4,134,547 | 1/1979 | Gamst | 417/196 |
| 4,308,138 | 12/1981 | Woltman | 261/DIG. 75 |
| 4,464,314 | 8/1984 | Surovikin et al. | 261/79.2 |
| 4,683,122 | 7/1987 | Concordia et al. | 261/DIG. 75 |
| 4,701,194 | 10/1987 | Weyers et al. | 261/DIG. 75 |

FOREIGN PATENT DOCUMENTS

| | | | |
|---|---|---|---|
| 514514 | 10/1952 | Belgium | 261/DIG. 75 |
| 8501888 | 5/1985 | Sweden . | |
| 581493 | 11/1976 | Switzerland . | |
| 1265404 | 10/1986 | U.S.S.R. | 417/179 |
| 1582898 | 1/1981 | United Kingdom . | |

*Primary Examiner*—Tim Miles

*Attorney, Agent, or Firm*—Darby & Darby

[57] ABSTRACT

The invention relates to a multiple liquid injector composed of several identical elementary injection tubes 2, disposed in a rim around a central tube. Each tube 2 has an inlet conduit 3, itself comprising a converging truncated cone 6 and a cylinder 7, followed by an aeration zone 4 comprising an aeration chamber 8 fed tangentially by a conduit 9 perpendicular to the tubes 2, a jet centering funnel 10, followed by mixing cylinder 11, and lastly a diverging outlet conduit 12.

9 Claims, 1 Drawing Sheet

PRESSURIZED MIXING INJECTOR

In the paper industry, paper pulp is the object of many treatments of purification, separation and various filtrations, of decontamination and deinking.

This invention relates to injection devices for pressured mixing of liquid and air, and notably paper pulp and air mixing devices used in cells for decontamination and de-inking by flotation.

One of the known techniques of decontamination and de-inking consists in injecting air into the pulp to be treated, at the entrance to the cell. The air imprisons the charges and the ink particles in bubbles and entrains them to the surface to form a forth, which is then sucked toward a separator.

The de-inking performance depends mainly on the quality of the mixture obtained in the injector. In fact, the pulp must be well aerated in order to retain the maximum quantity of particles in the air bubbles, and this aeration must be most homogeneous and most regularly distributed in the pulp. The bubbles must be very small, and even sporadic presence of big bubbles must be avoided.

In the technique of liquid-gas mixtures, numerous injectors have been designed, each giving particular results corresponding to the specific problem to be solved.

In the practice, as the rate of flow in these injectors is very high, a slight variation, whether in dimensions or in arrangement of the elements or in structure, suffices to considerably modify the results. Besides, it is normally impossible to foresee the operating results of an injector placed in conditions different from those which it was designed. Notably, one cannot interchange the results of a gas-gas mixing injector with those of a liquid-liquid mixing injector, and still less with those of a liquid-gas mixing injector.

In the field of paper pulp aeration before de-inking, what is involved is not to mix two substances of identical phase, nor merely to introduce air into a liquid containing ink and a large quantity of fibers, but above all to form bubbles, in very large number, and all of similar size.

Generally injectors are used which have an inlet for liquid under pressure and a nozzle type outlet; between the inlet and the outlet is an air intake and a cylinder in which the air, drawn in by the flow of the liquid, becomes mixed therein before reaching the conical part of the outlet. A device of this kind is described in Swiss patent CH-A-581,493.

These injectors normally have an air inflow tube, the end of which is coaxial with the liquid feed. In operation, in fact, the formation of a ring of air is observed around the end of the air tube, the air becoming mixed with the water at the downstream end of the ring. However, the mixing is not always of good quality because the ring is too short or too thin, or the mixture is irregularly distributed. As a result, the formation of the bubbles is irregular and the de-inking obtained is mediocre.

There are also mixing injectors in which the pulp flows in a nozzle type tubular conduit. In the narrowest part is lodged a profile of wing-shaped longitudinal section. The air is introduced almost radially into the narrowest part. Such a device is described in patent WO-A-85 01888.

However, such types of injectors still give only poor results.

The quanity of air sucked up in this type of injector depends mainly on the feed pressure; it may be, for example, of the order of 150% of the volume of liquid; but the problem is not so much to obtain a heavy flow of sucked up air but rather to ensure a great and constant homogeneity of the liquid-air mixture.

It is found also that the quantity of liquid itself cannot exceed a certain limit, as the discharge speed would be too high, and the impact of the discharging bubbles against the ambient air would cause them to burst and the ink would then return in liquid phase.

The flow of liquid accepted by an injector cannot be increased indefinitely by increasing the cross section of the mixing cylinder. There is a maximum cross section. It is found, for example, that for a diameter greater than about 8 mm the aeration becomes irregular—formation of big bubbles, variable air flow, de-inking of reduced quality.

This problem is therefore generally solved by using several classic injectors fed in parallel. But these injectors are of small cross section and so have the disadvantage of easily clogging. When operation is stopped, the impurities deposit in the conduits, upstream of the injectors, they agglomerate and dry rather quickly. When starting up, they become detached and cause obturations of the injectors. These injectors, which are generally formed of a single block, must be dismantled completely to unclog them.

Patent GB-A-1,582,898 descirbed another injection and mixing device in which the liquid feed conduit is divided into a plurality of small nozzle tips leading into a common chamber supplied with air. Facing each of these nozzle tips a venturi type outlet is disposed.

However, while this device can function as a pump, it does not give satisfactory results in this de-inking. The bubbles are irregular and burst, letting the ink escape.

The object of the present invention is a liquid-air mixing injector of high rate of flow, strong and regular aeration of the liquid, and which solves the clogging problems.

It relates to a liquid-air mixing injector of the type including a feed of liquid under pressure, a feed of air at atmospheric pressure, at least one injection tube, each tube comprising successively a converging inlet conduit, an aeration space, a cylindrical mixing conduit, and a diverging conical outlet and draft conduit, characterized in that, in combination:

the aeration space is planar and perpendicular to the longitudinal axis of the injector, and it is limited by the walls of a cylindrical chamber whose axis is parallel to said axis of the injector, and fed tangentially so as to form a current of air rotating in the chamber;

the diameter of the mixing conduit is constant and slightly greater than that of the inlet conduit;

the length of the mixing conduit is much greater than its diameter, of the order of 4 to 9 times;

the length of the outlet conduit is at least equal to that of mixing conduit and the opening angle alpha of the core is of the order of 1° to 3°.

The injector is further distinguished by the following characteristics:

The air inlet is disposed horizontally at the lower portion of the injector;

the injector has a plurality of parallel injection tubes, arranged in a rim around a central injection tube, and all have the same dimensions;

the mixing conduit of each tube has a jet receiving an centering funnel, converging toward said mixing conduit;

the inlet diameter of the funnel is equal at most to 1.5 times that of the inlet conduit, and the length of the funnel is substantially equal to its diameter;

the aeration space has the form of a circular disk into which the pulp inlet conduits discharge perpendicularly;

said disk being of a thickness substantially close to the diameter of an inlet conduit, and it has a tangential air inlet;

the thickness of the aeration disk is between 5 and 15 mm, preferably between 10 and 12 mm;

the injector consists of two parts,-one comprising the inlet conduit(s) and a tangential air inflow conduit, the other comprising the jet receiving and centering funnels, the mixing conduits, the divergent outlet cones, the two parts being assembled by screwing or other known means, so that the assembly forms between the two parts a space communicating with the air inflow conduit, in the form of a planar disk or cylinder, separating the liquid inlet conduits from the mixture outlet conduits.

The injector according to the invention brings the following advantages:

1. The aeration of the liquid is improved in quality and regularityhigh rate of flow of air sucked in followed by strong de-inking. The improvement is remarkable even with large percentages of air, of the order of 150%.

2. The installation is simplified as it is possible to replace, for example, the 16 unified injectors presently distributed over the periphery of the cell by one or two multiple injectors according to the invention.

3. Cleaning is easy because of the design in two easily removable parts.

By way of example and for better comprehension of the invention the annexed drawing shows:

Figure 2:
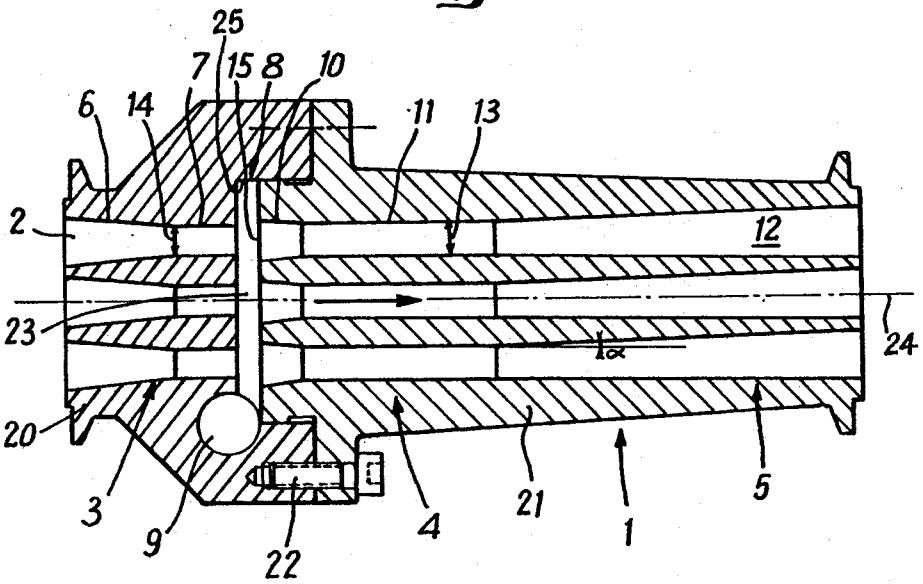
FIG. 2, a view in longitudinal section A—A of the injector of FIG. 1.
Figure 1:
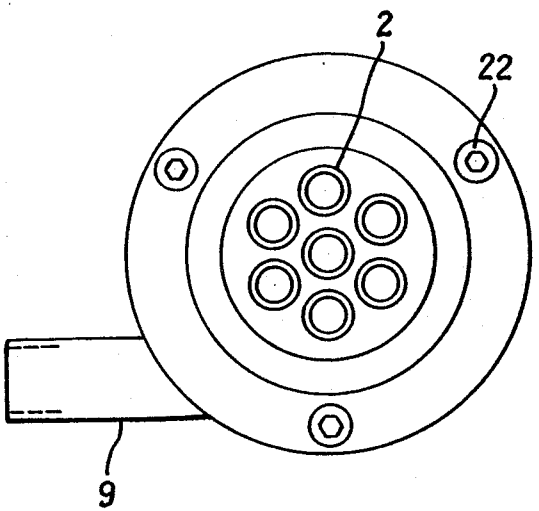
FIG. 1, a diagrammatic front view of an injector according to the invention.

As the drawing shows, the injector 1 is generally cylindrical and comprises a plurality of parallel, preferably identical injection tubes 2-six peripheral tubes 2 regularly distributed in a rim around a central tube, each being at equal distance from its immediate neighbors.

But the invention is not limited to this example of realization and the injector 1 may include a greater or lesser number of tubes, or even have a single one.

Each tube has an inlet conduit 3 for the liquid, a zone 4 for aeration and mixing of the liquid and air, and an outlet conduit 5.

The inlet conduit 3 has a converging truncated cone 6, followed by a cylinder 7, both of round cross section. The cylindrical section 7 may be very short, it may even be nonexisting; its function is to stabilize the direction of flow after the inlet cone 6.

The aeration and mixing zone 4 of a tube 2 comprises successively:

an aeration space 8 limited by the walls 25 of a chamber of round crosssection, communicating with the outside through an air inlet conduit 9 disposed tangentially to the chamber and perpendicularly to the direction of flow of the liquid;

a converging truncated cone, or jet centering funnel 10, of round crosssection, followed by a mixing cylinder 11 of round cross section.

the outlet conduit 5 of a tube 2 with a diffuser 12, of round cross section, for draft or detention of frothy mixture.

The various truncated cone and cylindrical portions of each tube are coaxial.

The cylindrical chamber 8 is a single volume, common to all injection tubes 2 in such a way that the injector has a bundle of inlet tubes 3 which all discharge into chamber 8, and a bundle of outlet tubes 5, which start from chamber 8 toward the exit of the injector 1.

In fact, chamber 8 presents toward the liquid a flat blade of air 23 which the jet must traverse; this blade is preferably perpendicular to the longitudinal axis 24 of the injector. The jet in the space of the chamber is thus always entirely surrounded by air and it can become aerated to the maximum. In the example of realization, the blade 23 is limited to a chamber-like space 8, but it is also possible not to limit the space to a chamber, by separating the inlet parts from the mixing and outlet parts, and keeping them coaxially aligned with a certain distance between them. With such a variant the jet would traverse a blade of air 23 not limited to the walls of a chamber.

The diameter 13 of the mixing cylinder is greater than the outlet diameter 14 of the inlet cylinder 7 in order to accept a flow of aerated liquid which is greater than the flow of liquid alone, and the inlet diameter 15 of the centering funnel 10 is substantially greater than the diameter 14 of the inlet cylinder 7 to present a large receiving surface to the liquid jet coming from cylinder 7.

The operation of the injector 1 is the following:

The liquid is fed under pressure into the inlet tubes 2; its speed increases in the truncated cone inlet section 6; it penetrates into the blade of air 23 and traverses it in the form of a jet, and then penetrates into the centering funnel 10.

The passage of the liquid at great speed across the blade of air 23 limited by the chamber 8 permits it a perfect aeration.

The conduit 9 for inflow of air into chamber 8 is disposed tangentially and perpendicularly to the direction of the tubes 2 in order to create a rotating movement, favoring the mixing of the air in the liquid and above all favoring the cleaning of said chamber.

Furthermore this conduit is disposed at the bottom under the axis of flow; this disposition permits:

1. to immediately evacuate the residual liquid when the operation of the installation is stopped, and to avoid crust formation;

2. in case of obstruction of one of the conduits 10,11,12, to send the liquid coming from the corresponding inlet conduit 3 into the other conduits 10,11,12, and to break up the particles which cause the obstruction.

The liquid then arrives in the cylindrical portion 11 of the mixing zone 4 where the air-liquid mixing takes place in the form of bubbles of very small dimensions and where the ink and the contaminants are trapped.

At the end of the run the mixture penetrates and traverses the diverging outlet cone 12, which is a draft cone.

For this structure of injectors to function correctly it is important to observe the orders of magnitude of the following dimensions:

The mixing conduit is of constant cross section slightly greater than that of the inlet conduit;

The mixing conduit is of a length much greater than its diameter, of the order of 4 to 8 times and more;

The outlet conduit is of a length at least equal to that of mixing conduit, and the opening angle alpha of the draft cone is very small, of the order of 1° to 3°;

The inlet cross section of the funnel is at most equal to 1.5 times that of the inlet conduit;

The length of the funnel is very small; at most it is equal to its diameter.

The thickness of the blade of air 23 is close to the diameter 14 of an inlet conduit.

The thickness of the blade of air 23 is between 5 and 15 mm, preferably between 10 and 12 mm. This thickness is proportional to the length of the fibers. When there is incipient clogging, the fibers must be able to spread in the chamber 25 and to flow through an unclogged tube. The fact that the thickness of the blade of air 23 is of the same magnitude as the length of the fibers thus prevents clogging of the injector and ensured its unclogging.

The illustrated embodiment presents the following dimensional characteristics:

The slope of the centering funnel 10 is of the order of 7%, the same as that of the inlet cone 6.

The opening ratio of the draft cone 12 is less than 2%, or an angle alpha of about 1° 30′, but these characteristics are not mandatory;

For a diameter 14 of the inlet conduit of 12 mm, the diameter 15 of the funnel is of the order of 16 mm, the length of the funnel of the order of 6 mm, the diameter 13 of the mixture conduit is of the order of 14 mm and its length 60 to 120 mm, the length of the outlet cone is 70 to 140 mm, the angle alpha about 1°, and the thickness of the blade of air is 10 to 12 mm.

Such multiple injectors offer both the advantages of the big injectors (large flow) and of the small injectors (maximum aeration) without having their disadvantages (much maintenance, costly equipments, valves, etc.).

Besides, in the variant illustrated, the injector 1 is made of two parts 20,21 assembled one against the other by screws 22 : the inlet part 20 includes the inlet zone 3, the outlet part 21 includes the centering funnel 10, the mixing cylinder 11 and the exit retention cone 12. A cylindrical recess is provided on one of the parts 20 or 21 (in the example it is part 20) to form the chamber 8 which defines a cavity in the form of a blade of air 23. A cavity is hollowed laterally in the recessed piece to form the tangential air inflow 9.

I claim:

1. Liquid-air mixing device of the pressurized injector type comprising a feed for liquid under pressure, a feed for air at atmospheric pressure, at least one injection tube, each tube comprising successively a converging inlet conduit, an aeration space, a cylindrical mixing conduit, and a diverging conical outlet and draft conduit, characterized in that in combination:

the aeration space (8) is planar and perpendicular to the longitudinal axis (24) of the injector, and it is limited by the walls (25) of a cylindrical chamber of an axis parallel to said axis of the injector, and fed tangentially so as to form a current of air rotating in the chamber;

the diameter (13) of the mixing conduit (11) is constant and slightly greater than the diameter (14) of the inlet conduit (7);

the length of the mixing conduit (11) is much greater than its diameter (13), of the order of 4 to 9 times;

the length of the outlet conduit (5) is at least equal to that of the mixing conduit (11) and the opening angle alpha of the cone is of the order of 1° to 3°.

2. Liquid-air mixing device according to claim 1, characterized in that the air inlet (9) is disposed horizontally at the lower portion of the injector (1).

3. Liquid-air mixing device according to claim 1, characterized in that the injector (1) has a plurality of parallel injection tubes (2) arranged in a rim around a central injection tube (2), and all have the same dimensions.

4. Liquid-air mixing device according to claim 1, characterized in that the mixing conduit (11) of each tube (2) has a jet receiving and centering funnel (10) converging toward said mixing conduit.

5. Liquid-air mixing device according to claim 1, characterized in that the inlet diameter (15) of the funnel (10) is at most equal to 1.5 times that of the inlet conduit (7), and the length of the funnel is substantially equal to its diameter (15).

6. Liquid-air mixing device according to claim 1, characterized in that the aeration space (8) has the form of a circular disk (23) into which the pulp inlet conduits lead perpendicularly and transversely.

7. Liquid-air mixing device according claim 1, characterized in that the thickness of the aeration space (8) is between 5 and 15 mm.

8. Liquid-air mixing device according to claim 6 characterized in that the disk (23) is of a thickness substantially close to the diameter (14) of an inlet conduit (7).

9. Liquid-air mixing device according to claim 1, characterized in that the injector consists of two parts (20,21), one (20) comprising the inlet conduit(s) (3) and a tangential air inflow conduit (9), the other (21) comprising the jet receiving and centering funnels (10), the mixing conduits (11), the diverging outlet cones (12), the two parts being assembled by screws (22) or other known means, in such a way that the assembly forms between the two parts (20,21) a space (8) communicating with the air inflow conduit (9), in the form of a flat disk (23) of cylinder, separating the inlet conduits for liquid from the outlet conduits for mixture.

* * * * *